US009080562B2

(12) United States Patent
Moreira et al.

(10) Patent No.: US 9,080,562 B2
(45) Date of Patent: Jul. 14, 2015

(54) SUCTION ARRANGEMENT FOR A HERMETIC REFRIGERATION COMPRESSOR

(75) Inventors: Emerson Moreira, Joinville-SC (BR); Fabian Fagotti, Beijing (CN); Gustavo Cardoso Weber, Joinville-SC (BR); Milton Wetzel Pereira, Joinville-SC (BR); Ricardo Alexandre Maciel, Joinville-SC (BR)

(73) Assignee: Whirlpool S.A., Sao Paulo (BR)

( * ) Notice: Subject to any disclaimer, the term of this patent is extended or adjusted under 35 U.S.C. 154(b) by 1164 days.

(21) Appl. No.: 12/737,963

(22) PCT Filed: Sep. 1, 2009

(86) PCT No.: PCT/BR2009/000278

§ 371 (c)(1),
(2), (4) Date: Nov. 15, 2011

(87) PCT Pub. No.: WO2010/025534

PCT Pub. Date: Mar. 11, 2010

(65) Prior Publication Data

US 2012/0063937 A1 Mar. 15, 2012

(30) Foreign Application Priority Data

Sep. 5, 2008 (BR) ..... 0803457

(51) Int. Cl.
*F04B 39/00* (2006.01)
*F04B 39/12* (2006.01)
(Continued)

(52) U.S. Cl.
CPC ..... *F04B 39/0061* (2013.01); *F04B 39/12* (2013.01); *F04B 39/122* (2013.01); *F04B 39/123* (2013.01); *F04B 39/125* (2013.01); *F04B 53/002* (2013.01);
(Continued)

(58) Field of Classification Search
CPC ..... F04B 53/002; F04B 53/007; F04B 53/16; F04B 39/12; F04B 39/122; F04B 39/123; F04B 39/125
USPC ..... 417/312, 542, 902, 571
See application file for complete search history.

(56) References Cited

U.S. PATENT DOCUMENTS 2,274,942 A * 3/1942 Touborg ..... 92/154
2,505,709 A * 4/1950 Goldberg et al. ..... 417/415
(Continued)

FOREIGN PATENT DOCUMENTS

EP 2 037 122 A1 3/2009
WO WO 2005/026548 A1 3/2005
(Continued)

*Primary Examiner* — Devon Kramer
*Assistant Examiner* — Christopher Bobish
(74) *Attorney, Agent, or Firm* — Harrington & Smith

(57) ABSTRACT

The suction arrangement of the present invention is for a hermetic compressor of the type which includes a hermetic shell; a cylinder block defining, in a single piece, a shell portion and a compression cylinder having an end opened to the exterior of the hermetic shell and closed by a valve plate; a head affixed to the cylinder block onto the valve plate so as to define, with the latter, at least one suction chamber receiving refrigerant gas from a gas inlet pipe external to the hermetic shell. The suction arrangement of the present invention comprises a gas inlet duct defined through the shell portion and through the valve plate and having an outer end hermetically coupled to the gas inlet pipe and an inner end opened to the suction chamber.

37 Claims, 4 Drawing Sheets

(51) Int. Cl.

| | |
|---|---|
| ***F04B 53/00*** | (2006.01) |
| *F04B 53/16* | (2006.01) |
| *F04B 27/10* | (2006.01) |

(52) U.S. Cl.
CPC ..... *F04B 53/007* (2013.01); *F04B 27/1081* (2013.01); *F04B 53/16* (2013.01)

(56) References Cited

U.S. PATENT DOCUMENTS

| | | | | | |
|---|---|---|---|---|---|
| 2,913,168 | A * | 11/1959 | Heidorn | ..... | 417/269 |
| 3,237,852 | A * | 3/1966 | Shaw | ..... | 417/372 |
| 3,335,942 | A * | 8/1967 | Seigart | ..... | 417/384 |
| 3,584,981 | A * | 6/1971 | Worster | ..... | 417/542 |
| 6,056,517 | A * | 5/2000 | Obrist et al. | ..... | 417/319 |
| 7,540,720 | B2 * | 6/2009 | Enokijima et al. | ..... | 417/269 |
| 2004/0091370 | A1 * | 5/2004 | Yoon et al. | ..... | 417/269 |

FOREIGN PATENT DOCUMENTS

| | | | |
|---|---|---|---|
| WO | WO 2006/109239 | A1 | 10/2006 |
| WO | WO 2007/015223 | A2 | 2/2007 |
| WO | WO 2007/138877 | A1 | 12/2007 |

* cited by examiner

SUCTION ARRANGEMENT FOR A HERMETIC REFRIGERATION COMPRESSOR

FIELD OF THE INVENTION

The present invention refers to a gas suction constructive arrangement for a hermetic refrigeration compressor of the type which comprises a cylinder block defining a shell portion which is hermetically closed, at one end, by a cover, and which carries the motor-compressor assembly of the compressor. The motor-compressor assembly presents a piston reciprocating in the interior of a cylinder defined in the cylinder block and which is closed, at one end, by a head whose interior defines a discharge chamber. This compressor construction is, for example, of the type used in refrigeration systems in which the refrigerant fluid generally contains carbon in its composition, such as $CO_2$.

BACKGROUND OF THE INVENTION

The conventional reciprocating compressors generally present a hermetic shell, inside which is mounted a motor-compressor assembly in which the compression system presents a cylinder block having one end closed by a cylinder cover, affixed to the cylinder block generally by screws and which directs the gas to a suction chamber, made of a thermal insulating material and which is separated from or installed in the cast block of the compressor. The motor-compressor assembly is housed internally to the compressor shell at a certain distance from the inner wall thereof. Thus, the suction chamber, which has the function of insulating the gas temperature in the cylinder inlet, suffers the action of the inner temperature of the compressor, which temperature, on its turn, tends to be affected by the high temperature of the inner discharge chamber. This type of construction presents a spacing, provided between the relatively cold refrigerant gas being admitted in the suction chamber and the hot gas being discharged and which has a dimension approximately corresponding to the length of the suction chamber, said construction further providing the thermal insulation and, consequently, improving the performance. Other advantage comes from the perfect and reliable sealing between the high and low pressure sides of the compressor, increasing the reliability and reducing leak losses.

However, these conventional constructions are not generally used in refrigeration systems which operate with refrigerant fluid having carbon in its composition, such as $CO_2$, since such systems present operational pressures higher than those obtained with other refrigerant fluids, requiring stronger compressors.

In some of these constructions, the cylinder block defines part of the compressor shell, in which the motor assembly and the compression system of the compressor are mounted. The cylinder block defines, therewithin, a compression cylinder housing a piston which reciprocates in suction and discharge strokes of the refrigerant gas from and to a refrigeration system to which the compressor is associated. The compression cylinder is closed, at one end, by a valve plate onto which is mounted a head generally defining at least one of the suction and discharge chambers of the compressor. In the known constructions, the shell portion incorporating the cylinder block is hermetically closed by one or two end covers, one of which generally defining an oil sump in its interior.

In such constructions, the head affixed to the cylinder block is provided externally to the contour of the shell portion of the compressor, being affixed to the cylinder block by means of screws (WO2005/026548) or by welding.

The systems for fixing the head to the cylinder block, by means of screws, can present, over time, undesired leak of the refrigerant fluid in the form of gas. Since the head in these constructions is external to the contour of the shell portion, the refrigerant gas may leak to the environment in which the compressor is installed, resulting in volume loss of said gas in the refrigeration system.

Besides the possibility of gas leak, the known compressor constructions having the head external to the shell contour present an undesired noise level.

The construction applied to the outer head has the advantage of allowing a better dissipation of the heat generated by the gas compression in the discharge operation of the compressor. However, such known constructions also allows heating the inner parts of the compressor, due to the heat transferred from the head to the parts of said compressor provided adjacent to said head and, in some way, thermally associated with the suction.

SUMMARY OF THE INVENTION

It is an object of the present invention to provide a suction arrangement for a hermetic refrigeration compressor presenting a head external to the shell contour, which prevents the refrigerant fluid from leaking to the exterior of the compressor shell, improves the heat dissipation in the head region and presents a simple construction with a reduced cost.

It is another object of the present invention to provide an arrangement such as that cited above, which improves the noise attenuation in compressors presenting the head external to the contour of the shell portion.

Another object of the present invention is to provide an arrangement such as that cited above, which makes the oil, which is present in the refrigerant fluid being drawn to the compressor, be drained to the interior of the shell until reaching the crankcase (oil sump) in the bottom of the compressor shell.

The above-cited and other objects of the present invention are achieved through the provision of a suction arrangement for a hermetic refrigeration compressor of the type which comprises: a hermetic shell; a cylinder block defining, in a single piece, a shell portion and a compression cylinder having an end which is opened to the exterior of the hermetic shell; a valve plate closing said end of the compression cylinder; a head affixed to the cylinder block, onto the valve plate, so as to define with the latter at least one suction chamber, receiving refrigerant gas from a gas inlet pipe external to the hermetic shell, said arrangement further comprising a gas inlet duct defined through the shell portion and through the valve plate and having an outer end hermetically coupled to the gas inlet pipe and an inner end opened to the suction chamber.

According to a particular aspect of the present invention, the suction arrangement comprises a thermal insulating means in the form of a hollow body provided in the interior of the head and which defines at least one suction chamber.

In a particular construction, the hollow body defines, in a single piece, two suction chambers and incorporates, also in a single piece, a thermal insulating tubular sleeve, lining a through hole in the valve plate and which defines part of the gas inlet duct. In this construction, the gas inlet duct further comprises an inner passage provided through the shell portion and opened to the exterior thereof through the outer end of the gas inlet duct.

According to another aspect of the present invention, the hollow body inferiorly comprises an oil outlet defined in the suction chamber and opened to a draining channel provided through the shell portion and through the valve plate and having an inlet end opened to the suction chamber, through the oil outlet, and an outlet end opened to the interior of the hermetic shell, the inlet end of the draining channel being maintained in fluid communication with the oil outlet through a gap defined between the hollow body and an adjacent wall portion of the head.

In a particular aspect of the present invention, the cylinder block incorporates a tubular projection external to the shell and which peripherally surrounds the valve plate and at least part of the head. In another particular aspect of the present invention, the present suction arrangement further comprises an outer cover hermetically affixed to the tubular projection, so as to define, with the latter, a discharge plenum maintained in fluid communication with the discharge chamber, one of the parts defined by the tubular projection and by said outer cover being provided with a refrigerant gas outlet opened to the exterior of the hermetic shell.

The present invention economically and reliably solves the problem of the leaking of the working fluid of the compressor through the interfaces of the components exposed to the environment external to the head, in the constructions in which the latter is provided externally to the contour of the compressor shell. Said working fluid leaking occurs between the head and the shell in the region in which said parts are attached to each other only through screws, as disclosed, for example, in WO05/026548A1. Such leaks, when they occur, lead to the continuous decrease of the compressor efficiency.

The arrangement of the present invention also allows a better thermal insulation of the gas being drawn from the compressor environments which are at a higher temperature than that desirable for the suction.

The constructive compressor arrangement of the present invention provided with the outer cover further facilitates the heat exchange, through the head wall, of the relatively hot gas in the discharge chamber with the external environment, which acts in dissipating the heat coming from the discharge chamber.

According to another aspect of the present invention, the head provided with the outer cover allows noise attenuation, which is desirable in compressors operating with refrigerant gas $CO_2$ used for commercial refrigeration. This construction further provides an increase of the thermal exchange of the relatively hot gas in the discharge chamber with the external environment, reducing the overheating of the inner components of the compressor (which improves its reliability) and of the gas being drawn (which improves the compressor efficiency).

In another aspect of the present invention, the oil, which by chance is carried with the gas being drawn, is drained to a lower portion of the insert provided in the head, being hermetically directed, therefrom, to the interior of the compressor shell, until reaching an oil sump defined in a lower portion of the compressor shell, having as advantage the maintenance of an oil level adequate to lubricate the relatively moving parts of the compressor.

BRIEF DESCRIPTION OF THE DRAWINGS

The invention will be described below, with reference to the enclosed drawings, given by way of example of an embodiment of the invention and in which.

DESCRIPTION OF THE ILLUSTRATED EMBODIMENT

Figure 1:
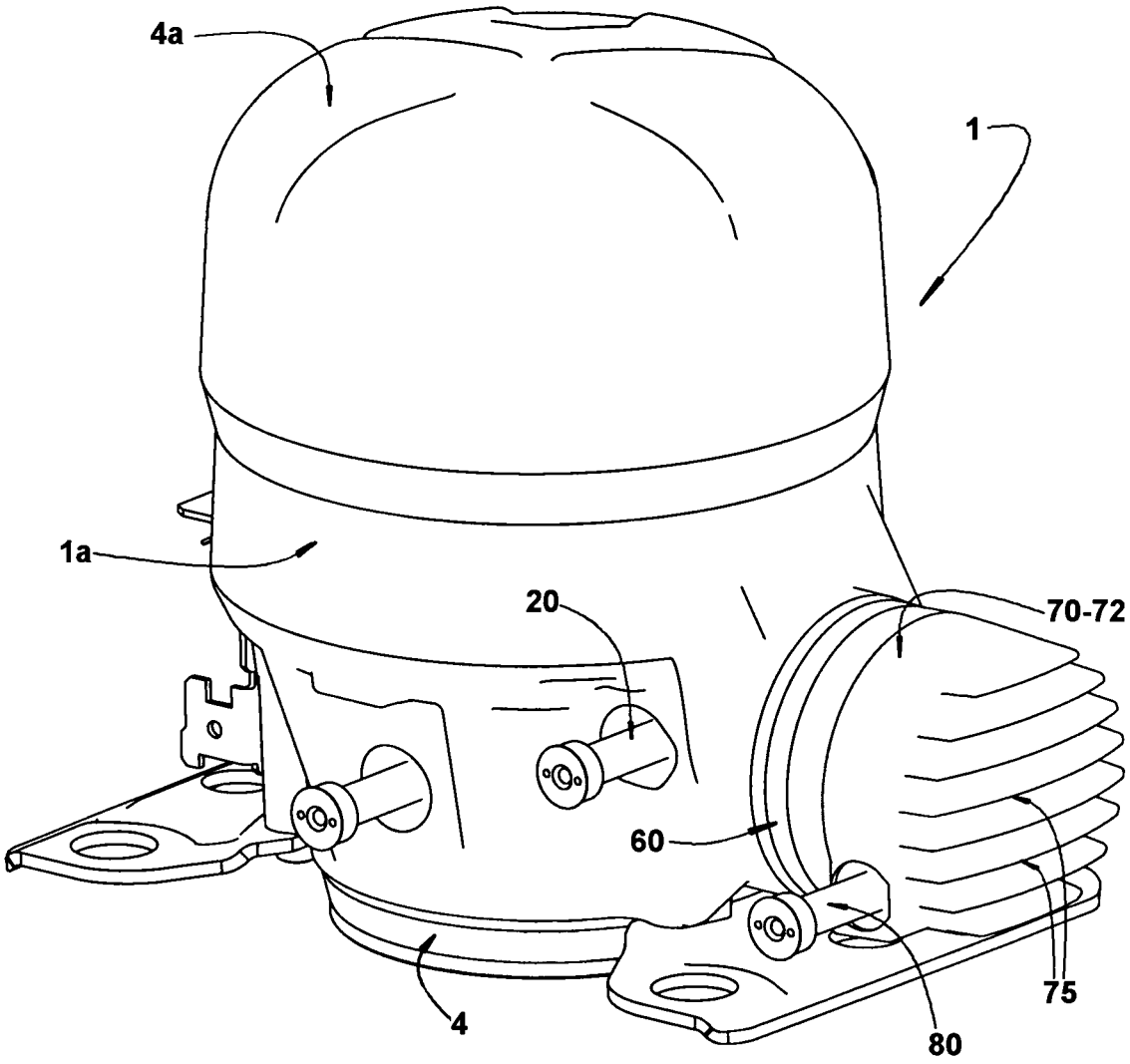
FIG. 1 schematically represents a perspective view of a hermetic refrigeration compressor to which is applied the present solution.
Figure 2:
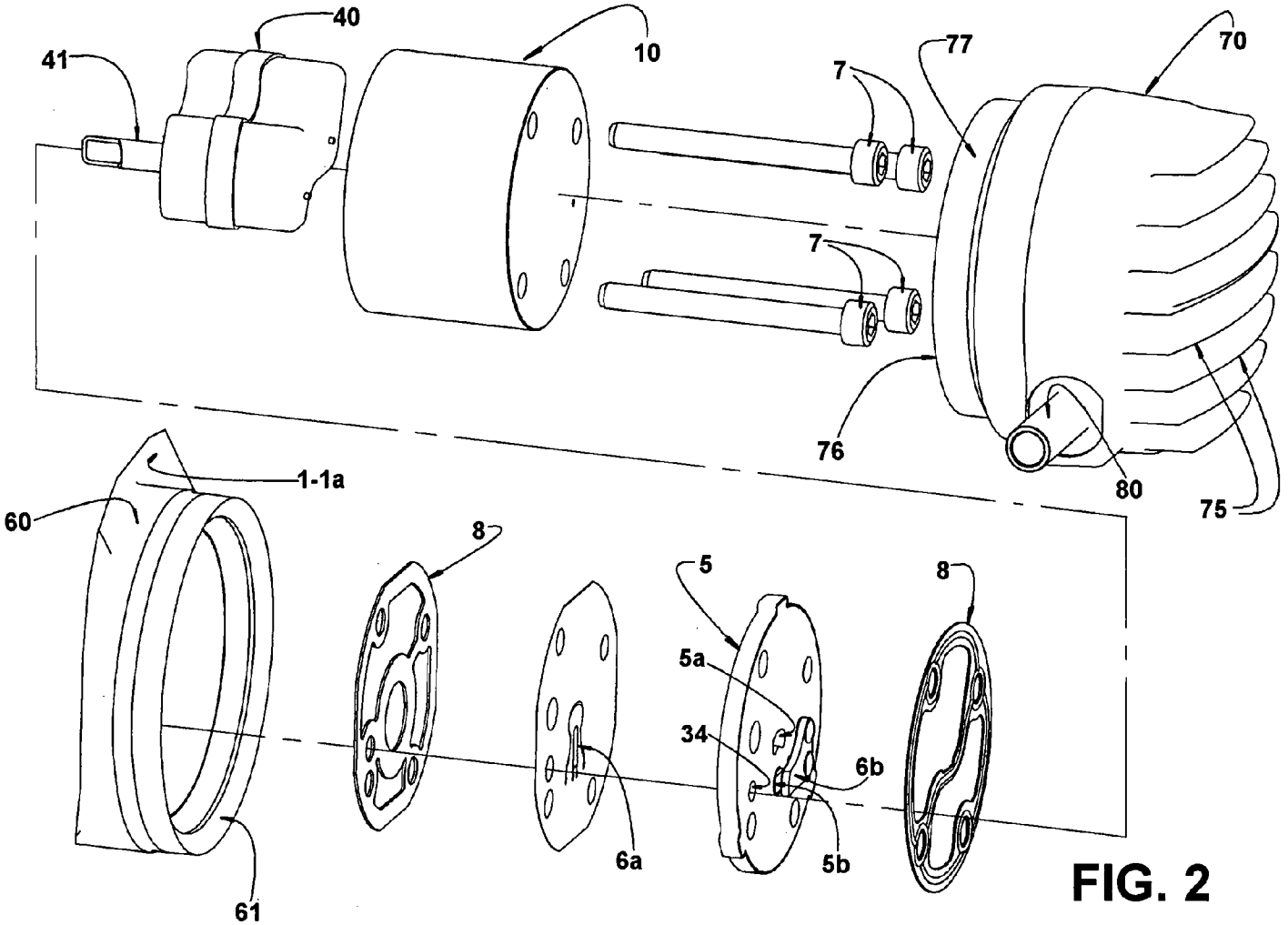
FIG. 2 schematically represents an exploded perspective view of the head and of the end cover of the present solution, which are illustrated in a mounted condition in FIG. 1.
Figure 3:
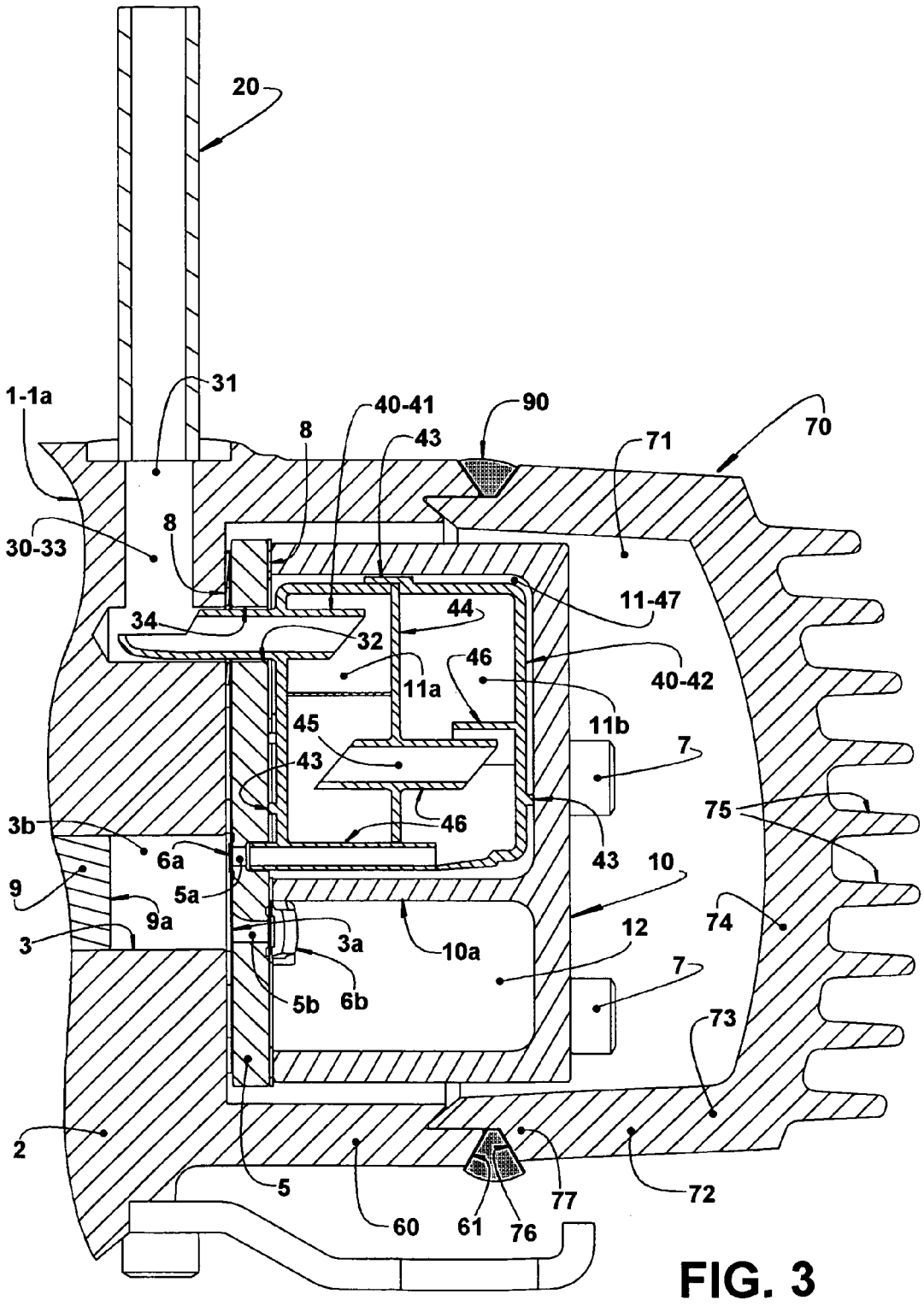
FIG. 3 schematically represents a first longitudinal sectional view of the head and of the end cover affixed to said head.
Figure 4:
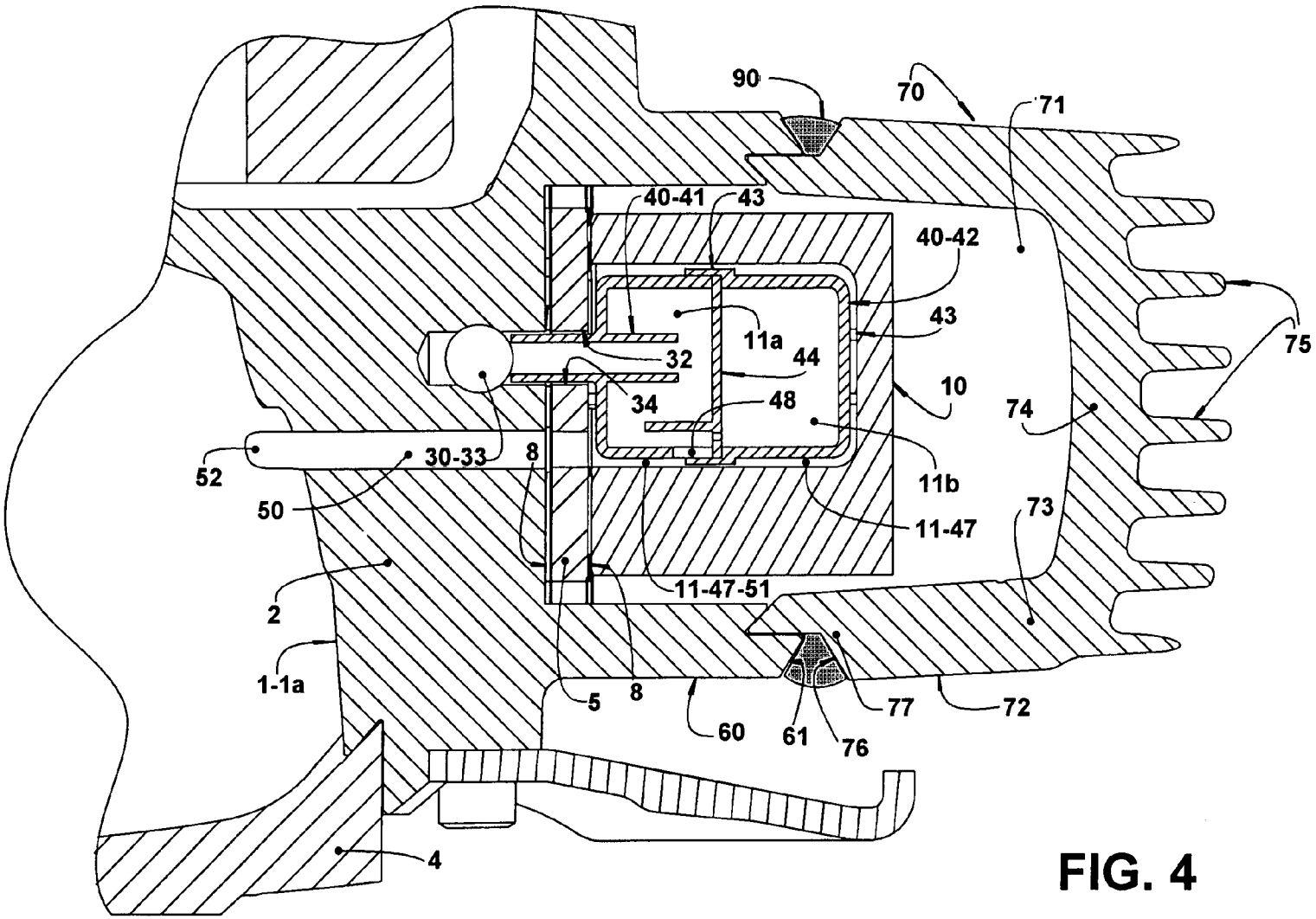
FIG. 4 schematically represents a second longitudinal sectional view of the head and of the end cover affixed to said head.

The present invention will be described for a hermetic refrigeration compressor of the type which comprises a hermetic shell 1 and a motor-compressor assembly, which includes a cylinder block 2 defining, in a single piece, a shell portion 1*a* of the hermetic shell 1 and a compression cylinder 3 having an end 3*a*, which is opened to the exterior of the hermetic shell 1.

The shell portion 1*a* receives and affixes at least one end cover 4 which, when positioned inferiorly to the shell portion 1*a*, generally internally defines an oil sump (not illustrated). The shell portion 1*a* and the end cover 4, when affixed to each other, define the hermetic shell 1. In the illustrated construction, the shell portion 1*a* receives and affixes an upper end cover 4*a* and a lower end cover 4.

The compression cylinder 3 presents its end 3*a*, which is opened to the exterior of the hermetic shell 1, closed by a valve plate 5 provided with a suction orifice 5*a* and a discharge orifice 5*b* which are respectively and selectively closed by a suction valve 6*a* and a discharge valve 6*b*.

The cylinder block 2 affixes, onto the valve plate 5, a head 10, so as to define therewith at least one suction chamber 11 receiving refrigerant gas from a gas inlet pipe 20 external to the hermetic shell 1, as described ahead. In the illustrated construction, the head 10 also defines a discharge chamber 12 and is affixed directly to the valve plate 5 mounted to the cylinder block 2 through screws 7, said assembly further including conventional sealing joints 8. However, it should be understood that the mounting of the head 10 to the cylinder block 2 can also be carried out by mounting said head 10 peripherally surrounding the valve plate 5 and being directly affixed to the cylinder block 2.

The compression cylinder 3 defines, between the valve plate 5 and a top portion 9*a* of a reciprocating piston 9 housed in the interior of the compression cylinder 3, a compression chamber 3*b*, in a selective fluid communication with at least one suction chamber 11 of the head 10, upon movement of the suction valve 6*a*.

The constructive suction arrangement of the present invention comprises a gas inlet duct 30 defined through the shell portion 1*a* and through the valve plate 5 and having an outer end 31 hermetically coupled to the gas inlet pipe 20, and an inner end 32 opened to the suction chamber 11. The gas inlet duct 30 comprises: at least one inner passage 33 provided through the shell portion 1*a* and opened to the exterior thereof through the outer end 31 of the gas inlet duct 30; and also a through hole 34 provided in the valve plate 5 and opened to the interior of the suction chamber 11 through the inner end 32 of the gas inlet duct 30. In the illustrated construction, the inner passage 33 presents an L-shaped profile having a first extension portion, starting from the outer end 31 of the gas inlet duct 30 and being orthogonal to the through hole 34, and a second extension portion which is orthogonal to the first extension portion and aligned with the through hole 34.

It should be understood that the illustrated constructive option represents one of the possible constructions for the inner passage 33, the same not being limitative of the present invention. In another constructive form for said inner passage 33, this is rectilinear and inclined in relation to the through hole 34, which may also present its axis in an angular position other than that orthogonal to a plane containing one of the faces of the valve plate 5, as illustrated herein.

In order to minimize the transfer of heat coming from the gas compressed in the compression chamber 3*b* to the gas being drawn, the constructive suction arrangement of the present invention comprises a thermal insulating means 40, which lines or constitutes at least one of the parts of through hole 34 and suction chamber 11, as presented ahead. For the constructions in which the heat transfer is carried out mainly or solely by the valve plate 5, it is only sufficient that the through hole 34 is thermally insulated, said insulation occurring with the provision of a thermal insulating means in the form of a thermal insulating tubular sleeve 41, as illustrated.

In the constructions in which heat transfer also occurs through the head 10, the head portion which defines the suction chamber 11 is internally lined with a thermal insulating means 40. In this case, the through hole 34 in the valve plate 5 is also internally lined with a thermal insulating means defined by a tubular sleeve 41.

According to a way of carrying out the present invention, the tubular sleeve 41 projects into at least one of the parts of suction chamber 11 and adjacent extension portion of the inner passage 33 of the gas inlet duct 30. In the illustrated constructions, the tubular sleeve 41 projects into the interior of the suction chamber 11 and into the interior of the adjacent extension portion of the inner passage 33 of the gas inlet duct 30 provided in the shell portion 1*a*, said projections being calculated so as to prevent gas from leaking through the sealing joints 8 used for mounting the valve plate 5 and the head 10 to the cylinder block 2, and so as to define a resonator for attenuating noise upon admission of gas to the compression chamber 3*b*.

In a way of carrying out the present invention, the tubular sleeve 41 is defined in a single piece with the thermal insulating means 40 which lines the suction chamber 11. In this construction, the thermal insulating means 40 can be defined by a film or material for lining the parts of suction chamber 11 and through hole 34, said lining material or film also acting in the acoustic insulation of the parts in which it is provided.

In another way of carrying out the present invention, the thermal insulating means 40 is defined by an insert, in a thermal insulating material, such as, for example PBT, said insert defining at least one suction chamber 11.

According to said construction of the present invention, the thermal insulating means 40 is defined by a hollow body 42 internally insulating the head portion in which at least one suction chamber 11 is defined. The hollow body 42 is provided in the interior of the head 10 with minimum contact in relation to the walls of the latter and also, preferably, separated from the discharge chamber (or chambers) 12 thereof by a wall 10*a*, defined in a single piece with the head 10 and which defines therein, and separated from each other, the suction chamber 11 and the discharge chamber 12. In the illustrated construction, the spacing between the hollow body 42 and the adjacent inner walls of the head 10 is obtained by means of spacers 43, for example, presenting a small contact area with the inner walls of the head 10, so as to form an air gap which insulates the gas (being drawn) from the heat dissipated by the discharge chamber 12.

In this way of carrying out the present invention, the through hole 34 in the valve plate 5 is internally lined with a thermal insulating means defined by a tubular sleeve 41, which is particularly incorporated, in a single piece, to the hollow body 42 which defines at least one suction chamber 11 in the interior of the head 10. In this construction, as already previously described, the tubular sleeve 41 projects into at least one of the parts defined by the suction chamber 11 defined by the hollow body 42 and by the inner passage 33 of the shell portion 1*a*.

It should be understood that the present invention, as described herein, is also applicable to a construction in which the head 10 presents a first suction chamber 11*a* and a second suction chamber 11*b* maintained in sequential fluid communication to each other, said first suction chamber 11*a* being in direct fluid communication with the gas inlet duct 30 and said second discharge chamber 11*b* being in fluid communication with the suction orifice 5*a*. In this case, at least one of the first suction chamber 11*a* and second suction chamber 11*b* is internally lined with a thermal insulating means 40, such as a hollow body 42 of the type already described herein and internally provided in the head portion 10, in which is defined the suction chamber 11 to be lined. It should be noted that the provision of the thermal insulating means 40 in the suction chamber (or chambers) 11 and of the thermal insulating means in the through hole 34 does not depend on the particular shape of said through hole 34 or of the inner passage 33.

As already described for a construction presenting a suction chamber 11, the hollow body 42 can incorporate the tubular sleeve 41 which lines the through hole 34. In the construction presenting a first suction chamber 11*a* and a second suction chamber 11*b*, it is possible to obtain the desired thermal insulation effect by providing the thermal insulating means 40 only in the suction chamber which is closest to the heat source of refrigerant gas being drawn.

According to the illustrated embodiment, the hollow body 42 is provided in the interior of the head 10, defining the first suction chamber 11*a* and the second suction chamber 11*b*, at least the hollow body 42 which defines the first suction chamber 11*a* incorporating, in a single piece, the tubular sleeve 41 which lines the through hole 34. In a particular way of carrying out the present invention, the hollow body 42 defines, in a single piece, the first suction chamber 11*a* and the second suction chamber 11*b* and, more particularly, it defines, also in a single piece, the tubular sleeve 41.

It should be understood that, as already described, the tubular sleeve 41 can project into the interior of at least one of the parts defined by the inner passage 33 of the gas inlet duct 30 of the shell portion 1*a* and by the first suction chamber 11*a*. In a particular constructive form of the present invention, the hollow body 42 presents a dividing wall 44, which is common to the first suction chamber 11*a* and to the second suction chamber 11*b*, and in which is defined at least one gas passage 45 provided with a duct portion 46 presenting a determined extension and a determined opening, which are designed to attenuate the gas noise through the first suction chamber 11*a* and through the second suction chamber 11*b*. In the construction in which the hollow body 42 defines, in a single piece, the first suction chamber 11*a* and the second suction chamber 11*b*, the dividing wall 44 is also defined in a single piece with the other constitutive parts of the hollow body 42. However, in the constructions in which the first suction chamber 11*a* does not define a hollow body in a single piece with the second suction chamber 11*b*, the dividing wall 44 can be incorporated to one of said first suction chamber 11*a* and second suction chamber 11*b* or also disposed between hollow body portions which, when mounted together with said dividing wall 44, define said first suction chamber 11*a* and second suction chamber 11*b*.

The duct portion 46 projects into at least one of the first suction chamber 11*a* and second suction chamber 11*b*, defining a resonator for attenuating noise during the suction. It should be understood that the hollow body 42 can also carry, in its interior, other duct portions to act as noise attenuators, each duct portion presenting a dimensioning that is defined as a function of the frequency band to be attenuated thereby.

It should be understood that the thermal insulating means 40 can be defined in a material which also acts for attenuating the noise during the gas suction effected by the compressor.

According to the present invention, the hollow body 42 is mounted in the interior of the head 10, so that at least part of its outer walls maintains a certain spacing in relation to the inner walls of said head 10, defining a gap 47 in this spacing, as described ahead.

The hollow body 42 comprises, inferiorly, an oil outlet 48 defined in the first suction chamber 11*a* and opened to a draining channel 50 provided through the shell portion 1*a* and through the valve plate 5, and having an inlet end 51 opened to the first suction chamber 11*a*, through the oil outlet 48 thereof, and an outlet end 52 opened to the interior of the hermetic shell 1, wherefrom the lubricant oil, which might have been carried by the refrigerant fluid into the suction chamber, is gravitationally released to the oil sump defined in the interior of the hermetic shell 1 of the compressor, close to the lower end cover 4 which defines part of said hermetic shell 1 and which is inferiorly affixed to the shell portion 1*a*.

In the illustrated construction, the inlet end 51 of the draining channel 50 is maintained in fluid communication with the oil outlet 48 of the first suction chamber 11*a*, through the gap 47 defined between the hollow body 42 and an adjacent wall portion of the head 10.

It should be understood that the oil outlet 48 can also incorporate a duct, such as that which defines the tubular sleeve 41 in the through hole 34 and which traverses the valve plate 5, in another opening provided in the latter and extending through at least part of the draining channel 50. In this case, it is not necessary to provide a gap 47, as described herein, for the purpose of draining oil, said gap 47 remaining only with the function of thermal insulation.

The provision of the oil outlet 48 in the first suction chamber 11*a* in the constructions in which there are two or more suction chambers, aims to minimize the possibility of the oil conveyed by the refrigerant fluid reaching the suction orifice 5*a*, said oil being drained outwardly from the head 10 soon after its admission in the interior thereof.

In the constructions in which the head 10 presents a single suction chamber 11, the oil outlet can be defined directly in the head 10, when the latter does not have a hollow body 42 mounted in its interior, or it can be defined in said hollow body 42, for any of the oil outlet constructions already described.

For any of the possible constructions of oil outlet 48, this must be provided inferiorly to the refrigerant gas inlet in the head 10 and spaced from the suction orifice 5*a*, so as to prevent the oil to be drained from migrating to said suction orifice 5*a*.

According to another aspect of the present invention, which can be applied to any of the constructions and variants described so far, the cylinder block 2 incorporates a tubular projection 60 external to the hermetic shell 1 and which peripherally surrounds the valve plate 5 and at least part of the head 10, said arrangement further comprising an outer cover 70 which is hermetically affixed, for example by welding, to the tubular projection 60, so as to define with the latter a discharge plenum 71 maintained in fluid communication with one of the discharge chambers 11. One of the parts defined by the tubular projection 60 and by said outer cover 70 is provided with a refrigerant gas outlet (not illustrated) opened to the exterior of the hermetic shell 1 and in hermetic fluid communication with a gas discharge pipe 80.

In a way of carrying out the present invention, the cylinder block 2 incorporates, in a single piece, the tubular projection 60, radially extending from the shell portion 1*a*. In a constructive variation, the tubular projection 60 is welded to the shell portion 1*a*, around the valve plate 5.

In the illustrated construction, the tubular projection 60 surrounds the head 10, maintaining therewith and along its peripheral contour, a radial spacing, for example constant and which defines part of the discharge plenum 71.

It should be understood that, although the tubular projection 60 surrounds the whole peripheral contour of the head 10, other constructions (not illustrated) are possible, such as the provision of a tubular projection 60 around only the portion of the head 10 in the interior of which the discharge chamber (or chambers) 12 is/are defined.

According to the present invention, the discharge plenum 71 is dimensioned so as to operate as a noise muffling chamber during the discharge of the compressed gas from the compression chamber 3*b*.

As illustrated, the outer cover 70 comprises a tubular body 72 closed, at one end 73, by a front wall 74 which externally incorporates, in a single piece, a plurality of heat dissipation fins 75. It should be understood that, although the illustrated construction externally presents the whole front wall 74 provided with heat dissipation fins 75, other constructions within the concept of providing fins for dissipating heat are possible, such as the provision of said fins on part the front wall 74 and also the provision of fins externally defined in the peripheral side surface of the tubular body 72 of the outer cover 70.

Although not illustrated, the outer cover 70 can be internally provided with noise absorbing means, such as a lining in a noise absorbing material, and/or provided with resonators appropriate for the frequency band to be attenuated.

According to the present invention and as illustrated, the tubular projection 60 presents a free end edge 61, against which is seated and affixed a peripheral edge 76 of an open opposite end 77 of the outer cover 70. In a way of carrying out the present invention, when the parts of tubular projection 60 and outer cover 70 are made of metallic material, the peripheral edge 76 of the outer cover 70 is affixed, by welding, to the free end edge 61 of the tubular projection 60. This welding can be obtained by conventional means, such as by applying a weld bead 90.

It should be understood that, according to the present invention, the fixation of the outer cover 70 in the tubular projection 60 can occur away from the seating region of the free end edge 61 and peripheral edge 77 of the outer cover 70, for example next to a side wall of the tubular projection 60.

The discharge of refrigerant gas from the compression cylinder to the refrigerant gas outlet is not illustrated and described herein, since it does not form part of the constructive suction arrangement object of the present invention. However, it should be understood that the discharge arrangement can be made independently of the suction arrangement described herein.

The suction chambers 11, besides insulating the gas being admitted to the compression chamber 3*b*, have the additional function of retaining the oil which returns with the refrigerant gas being drawn from the refrigeration system to which the compressor is coupled, preventing said oil from reaching the compression chamber 3*b*, returning said oil to the interior of the compressor, as well as providing noise attenuation of the gas being drawn.

The provision of a finned outer cover provides an increase of the thermal exchange of the relatively hot gas of the discharge with the external environment, reducing the superheating of the inner components of the compressor (which improves its reliability) and of the drawn gas, which improves the compressor efficiency.

In case the head 10 is welded, with or without screws, the problem of the leaking of the working fluid through the interfaces of the components exposed to the external environment, as it occurs in the screwed joint disclosed in WO05/026548A1, is economically and reliably solved. If such working fluid leaking occurs, the compressor efficiency will be reduced.

The construction described and illustrated herein improves the performance of the compressor, mainly in the constructions which use refrigerant gas containing carbon, such as the refrigerant gas R744 ($CO_2$).

While only one exemplary embodiment of the present invention has been illustrated herein, it should be understood that alterations can be made in the form and physical arrangement of the constitutive elements, without departing from the constructive concept defined in the claims that accompany the present specification.

The invention claimed is:

1. A hermetic refrigeration compressor suction arrangement, comprising:

a hermetic shell;

a cylinder block defining, in a single piece, a shell portion and a compression cylinder having an end which is opened to an exterior of the hermetic shell;

a valve plate closing said end of the compression cylinder;

a head affixed to the cylinder block on to the valve plate so as to define, with the valve plate, at least one suction chamber receiving refrigerant gas from a gas inlet pipe external to the hermetic shell and a gas inlet duct defined through the shell portion and through the valve plate and having an outer end hermetically coupled to the gas inlet pipe and an inner end opened to the suction chamber;

a tubular projection incorporated, in a single piece, to the cylinder block and radially extending from the shell portion, external to the hermetic shell and peripherally surrounding the valve plate and at least part the head; and an outer cover hermetically affixed to the tubular projection so as to define with the tubular projection a discharge plenum, the tubular projection maintaining with the head and along the peripheral contour of the head a radial spacing which defines part of the discharge plenum.

2. The suction arrangement, as set forth in claim 1, characterized in that the gas inlet duct comprises: at least one inner passage provided through the shell portion and opened to the exterior thereof through the outer end of the gas inlet duct; and also a through hole provided in the valve plate and opened to an interior of the suction chamber through the inner end of the gas inlet duct.

3. The suction arrangement, as set forth in claim 2, characterized in that a portion of the head which defines the suction chamber is internally lined with a thermal insulator.

4. The suction arrangement, as set forth in claim 3, characterized in that the through hole in the valve plate is internally lined with a thermal insulator.

5. The suction arrangement, as set forth in claim 4, characterized in that the thermal insulator of the through hole is defined by a tubular sleeve.

6. The suction arrangement, as set forth in claim 5, characterized in that the tubular sleeve projects into the suction chamber.

7. The suction arrangement, as set forth in claim 6, characterized in that the tubular sleeve is defined in a single piece with the thermal insulator which lines the suction chamber.

8. The suction arrangement, as set forth in claim 6, characterized in that the tubular sleeve projects to an interior of the inner passage in the shell portion.

9. The suction arrangement, as set forth in claim 3, characterized in that the thermal insulator is defined by a hollow body internally insulating the head portion in which the suction chamber is defined.

10. The suction arrangement, as set forth in claim 9, characterized in that the through hole in the valve plate is internally lined with a thermal insulator defined by a tubular sleeve.

11. The suction arrangement, as set forth in claim 10, characterized in that the tubular sleeve is incorporated, in a single piece, to said hollow body.

12. The suction arrangement, as set forth in claim 11, characterized in that the tubular sleeve projects into the suction chamber.

13. The suction arrangement, as set forth in claim 11, characterized in that the tubular sleeve projects to an interior of the inner passage of the shell portion.

14. The suction arrangement, as set forth in claim 2, characterized in that the through hole in the valve plate is internally lined by a thermal insulating tubular sleeve.

15. The suction arrangement, as set forth in claim 1 and in which the valve plate is provided with a suction orifice, characterized in that the head presents a first suction chamber and a second suction chamber which are maintained in a sequential fluid communication with each other, said first suction chamber being in direct fluid communication with the gas inlet duct and said second suction chamber being in fluid communication with the suction orifice.

16. The suction arrangement, as set forth in claim 15, characterized in that at least one of the first suction chamber and second suction chamber is internally lined with a thermal insulator.

17. The suction arrangement, as set forth in claim 16, characterized in that the thermal insulator is defined by a hollow body internally provided in a portion of the head in which the suction chamber is defined.

18. The suction arrangement, as set forth in claim 17, characterized in that the gas inlet duct comprises: at least one inner passage provided through the shell portion and opened to an exterior of the shell portion through the outer end of the gas inlet duct; and also a through hole provided in the valve plate and opened to an interior of the suction chamber through the inner end of the gas inlet duct.

19. The suction arrangement, as set forth in claim 18, characterized in that the through hole in the valve plate is internally lined with a thermal insulator in the form of a tubular sleeve.

20. The suction arrangement, as set forth in claim 19, characterized in that the tubular sleeve is incorporated, in a single piece, to said hollow body.

21. The suction arrangement, as set forth in claim 20, characterized in that the tubular sleeve projects into the suction chamber.

22. The suction arrangement, as set forth in claim 20, characterized in that the tubular sleeve projects to an interior of the inner passage of the shell portion.

23. The suction arrangement, as set forth in claim 17, characterized in that the hollow body defines, in a single piece, the first suction chamber and the second suction chamber.

24. The suction arrangement, as set forth in claim 18, characterized in that the hollow body presents a common dividing wall between the first suction chamber and the second suction chamber and in which there is defined at least one gas passage provided with a duct portion presenting a determined extension and an opening defined so that said duct portion acts in noise attenuation of the gas through the first suction chamber and second suction chamber.

25. The suction arrangement, as set forth in claim 24, characterized in that the duct portion projects into at least one of the first suction chamber and second suction chamber.

26. The suction arrangement, as set forth in claim 17, characterized in that the hollow body interiorly comprises an oil outlet defined in the first suction chamber and opened to a draining channel provided through the shell portion and through the valve plate and having an inlet end opened to the first suction chamber, through the oil outlet, and an outlet end opened to the interior of the hermetic shell.

27. The suction arrangement, as set forth in claim 26, characterized in that the inlet end of the draining channel is maintained in fluid communication with the oil outlet through a gap defined between the hollow body and an adjacent wall portion of the head.

28. The suction arrangement, as set forth in claim 9, characterized in that the hollow body interiorly comprises an oil outlet defined in the suction chamber and opened to a draining channel provided through the shell portion and through the valve plate and having an inlet end opened to the suction chamber, through the oil outlet, and an outlet end opened to the interior of the hermetic shell.

29. The suction arrangement, as set forth in claim 28, characterized in that the inlet end of the draining channel is maintained in fluid communication with the oil outlet through a gap defined between the hollow body and an adjacent wall portion of the head.

30. The suction arrangement, as set forth in claim 1, characterized in that the discharge plenum is maintained in fluid communication with a discharge chamber, and one of the tubular projection or said outer cover is provided with a refrigerant gas outlet opened to the exterior of the hermetic shell.

31. The suction arrangement, as set forth in claim 30, characterized in that the discharge plenum is dimensioned so as to define a noise muffling chamber.

32. The suction arrangement, as set forth in claim 30, characterized in that the outer cover is provided, in at least part of its outer surface, with heat dissipation fins.

33. The suction arrangement, as set forth in claim 30 and in which the tubular projection presents a free end edge, characterized in that the outer cover comprises a tubular body closed, at one end, by a front wall and having a peripheral edge of an open opposite end affixed to the free end edge of the tubular projection.

34. The suction arrangement, as set forth in claim 33, characterized in that the refrigerant gas outlet is radially provided in the outer cover, affixing the end of a gas discharge pipe external to the hermetic shell.

35. The suction arrangement, as set forth in claim 33, characterized in that the fixation between the tubular projection and the outer cover is made by welding.

36. The suction arrangement, as set forth in claim 33, characterized in that the front wall of the outer cover externally incorporates, in a single piece, a plurality of heat dissipation fins.

37. The suction arrangement, as set forth in claim 30, characterized in that the refrigerant gas outlet affixes to the end of a gas discharge pipe external to the hermetic shell.

* * * * *